US011807988B2

(12) United States Patent
Nakamura et al.

(10) Patent No.: US 11,807,988 B2
(45) **Date of Patent: *Nov. 7, 2023**

(54) SHEET MANUFACTURING METHOD AND SHEET MANUFACTURING APPARATUS

(71) Applicant: SEIKO EPSON CORPORATION, Tokyo (JP)

(72) Inventors: Masahide Nakamura, Nagano (JP); Hideki Tanaka, Nagano (JP); Yoshiyuki Nagai, Nagano (JP); Yoko Nakai, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/656,902

(22) Filed: Mar. 29, 2022

(65) Prior Publication Data

US 2022/0316138 A1 Oct. 6, 2022

(30) Foreign Application Priority Data

Mar. 31, 2021 (JP) ..... 2021-059787

(51) Int. Cl.

| | |
|---|---|
| ***D21F 7/00*** | (2006.01) |
| ***D21F 1/66*** | (2006.01) |
| ***D21F 3/02*** | (2006.01) |
| ***D21F 9/04*** | (2006.01) |
| ***D21F 11/06*** | (2006.01) |

(52) U.S. Cl.

CPC ..... *D21F 7/003* (2013.01); *D21F 1/66* (2013.01); *D21F 3/0272* (2013.01); *D21F 9/04* (2013.01); *D21F 11/06* (2013.01)

(58) Field of Classification Search

CPC ..... D21F 7/003; D21F 1/66; D21F 3/0272; D21F 9/04; D21F 11/06; D21F 9/00; B27N 1/00; B27N 3/04; B27N 3/18; D21G 7/00

See application file for complete search history.

(56) References Cited

U.S. PATENT DOCUMENTS

| | | | |
|---|---|---|---|
| 2003/0236511 | A1 | 12/2003 | Jones et al. |
| 2014/0027075 | A1 | 1/2014 | Yamagami et al. |
| 2015/0204015 | A1 | 7/2015 | Gomi et al. |
| 2016/0230338 | A1 | 8/2016 | Nakamura et al. |

(Continued)

FOREIGN PATENT DOCUMENTS

| | | | |
|---|---|---|---|
| CN | 1675424 | A | 9/2005 |
| CN | 110894283 | A | 3/2020 |

(Continued)

*Primary Examiner* — Eric Hug
*Assistant Examiner* — Matthew M Eslami
(74) *Attorney, Agent, or Firm* — Global IP Counselors, LLP

(57) ABSTRACT

A sheet manufacturing method includes a web forming step of forming a web by accumulating a defibrated product in a dry manner, a moisture imparting step of imparting the web with moisture, a pressurizing step of pressurizing the web to which the moisture is imparted, and a heating step of heating the web to which the moisture is imparted, in which a water content of the web to which the moisture is imparted in the moisture imparting step is 12% by mass or more, a pressure applied to the web in the pressurizing step is 0.2 MPa or more, and a temperature of the web in the heating step is 100° C. or lower.

8 Claims, 5 Drawing Sheets

(56) References Cited

U.S. PATENT DOCUMENTS

| | | | | |
|---|---|---|---|---|
| 2018/0080176 | A1 | 3/2018 | Higuchi | |
| 2019/0232606 | A1* | 8/2019 | Ota | D04H 1/54 |
| 2020/0080262 | A1 | 3/2020 | Sago et al. | |
| 2022/0097262 | A1* | 3/2022 | Nakai | B29C 43/006 |

FOREIGN PATENT DOCUMENTS

| | | | |
|---|---|---|---|
| EP | 3 281 756 | A1 | 2/2018 |
| EP | 3 508 637 | A1 | 7/2019 |
| EP | 3 974 579 | A1 | 3/2022 |
| JP | 2012-144819 | A | 8/2012 |
| JP | 2015-066932 | A | 4/2015 |
| JP | 2015-137437 | A | 7/2015 |
| JP | 2020-016004 | A | 1/2020 |

* cited by examiner

FIG. 3

| No. | PRODUCTION CONDITION | | | | EVALUATION RESULT | | | |
|---|---|---|---|---|---|---|---|---|
| | WATER CONTENT [% BY MASS] | PRESSURE [MPa] | SHEET TEMPERATURE [°C] | ROLLER TEMPERATURE [°C] | STRENGTH [N・m/g] | DENSITY [g/cm$^3$] | DRYING TIME [s] | REPEATED RECYCLE RC3/RC1 |
| 1 | 20 | 0.6 | 85 | 115 | A | A | A | A |
| 2 | 20 | 0.6 | 52 | 55 | A | A | C | – |
| 3 | 20 | 0.6 | 107 | 160 | C | C | A | – |
| 4 | 20 | 0.1 | 83 | 115 | C | C | A | – |
| 5 | 20 | 13.0 | 82 | 115 | A | A | A | C |
| 6 | 10 | 0.6 | 91 | 110 | C | C | A | – |
| 7 | 52 | 0.6 | 96 | 115 | A | A | C | – |
| 8 | 14 | 2.0 | 86 | 110 | B | A | A | B |
| 9 | 30 | 0.5 | 93 | 130 | A | A | B | A |
| 10 | 35 | 0.3 | 91 | 130 | B | B | B | A |

SHEET MANUFACTURING METHOD AND SHEET MANUFACTURING APPARATUS

The present application is based on, and claims priority from JP Application Serial Number 2021-059787, filed Mar. 31, 2021, the disclosure of which is hereby incorporated by reference herein in its entirety.

BACKGROUND

1. Technical Field

The present disclosure relates to a sheet manufacturing method and a sheet manufacturing apparatus.

2. Related Art

A dry sheet manufacturing method has been proposed for miniaturization and energy saving.

For example, JP-A-2015-137437 describes a sheet manufacturing method including a defibrating step of defibrating a defibrated product in the atmosphere, a mixing step of mixing an additive containing a resin with the defibrated product defibrated in the atmosphere, a humidity control step of humidity-controlling a mixture in which the defibrated product is mixed with the additive, and a heating step of heating the humidity-controlled mixture.

However, in JP-A-2015-137437, a resin is required as a binder to manufacture a sheet having sufficient strength. In recent years, there has been a demand for a method for manufacturing a sheet having sufficient strength without using a resin.

SUMMARY

According to an aspect of the present disclosure, a sheet manufacturing method includes a web forming step of forming a web by accumulating a defibrated product in a dry manner, a moisture imparting step of imparting the web with moisture, a pressurizing step of pressurizing the web to which the moisture is imparted, and a heating step of heating the web to which the moisture is imparted, in which a water content of the web to which the moisture is imparted in the moisture imparting step is 12% by mass or more, a pressure applied to the web in the pressurizing step is 0.2 MPa or more, and a temperature of the web in the heating step is 100° C. or lower.

According to an aspect of the present disclosure, a sheet manufacturing apparatus includes a web forming portion that forms a web by accumulating a defibrated product in a dry manner, a moisture imparting portion that imparts moisture to the web, a pressurizing portion that pressurizes the web to which the moisture is imparted, and a heating portion that heats the web to which the moisture is imparted, in which a water content of the web to which the moisture is imparted in the moisture imparting portion is 12% by mass or more, a pressure applied to the web in the pressurizing portion is 0.2 MPa or more, and a temperature of the web in the heating portion is 100° C. or lower.

BRIEF DESCRIPTION OF THE DRAWINGS

FIG. 3 is a table illustrating production conditions and evaluation results.

DESCRIPTION OF EXEMPLARY EMBODIMENTS

Hereinafter, preferred embodiments of the present disclosure will be described in detail with reference to the drawings. The embodiments described below do not unreasonably limit the content of the present disclosure described in the claims. Further, not all of the configurations described below are essential constituent requirements of the present disclosure.

A sheet manufacturing method according to the present embodiment includes a web forming step of forming a web by accumulating a defibrated product in a dry manner, a moisture imparting step of imparting moisture to the web, a pressurizing step of pressurizing the web to which the moisture is imparted, and a heating step of heating the web to which the moisture is imparted. Hereinafter, an example of a sheet manufacturing apparatus capable of implementing the sheet manufacturing method of the present embodiment will be described, and then the sheet manufacturing method will be described.

1. Sheet Manufacturing Apparatus

Figure 1:
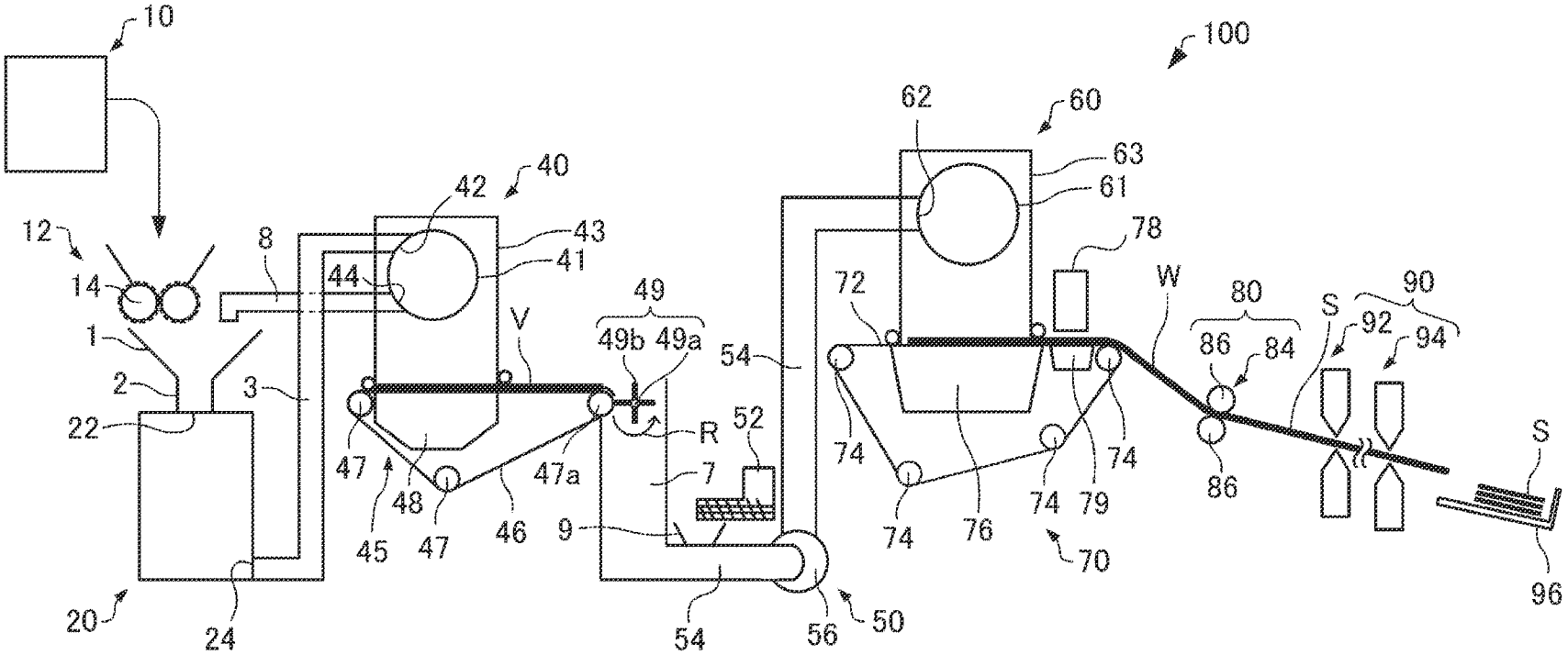
FIG. 1 is a diagram schematically illustrating a sheet manufacturing apparatus according to a present embodiment.

An example of the sheet manufacturing apparatus according to the present embodiment suitable for the sheet manufacturing method of the present embodiment will be described with reference to the drawings. FIG. 1 is a diagram schematically illustrating a sheet manufacturing apparatus 100 according to the present embodiment.

As illustrated in FIG. 1, the sheet manufacturing apparatus 100 includes, for example, a supply portion 10, a coarse crushing portion 12, a defibrating portion 20, a sorting portion 40, a first web forming portion 45, a rotating body 49, a mixing portion 50, an accumulating portion 60, a second web forming portion 70, a sheet forming portion 80, and a cutting portion 90.

The supply portion 10 supplies the raw material to the coarse crushing portion 12. The supply portion 10 is, for example, an automatic charging portion for continuously charging the raw material into the coarse crushing portion 12. The raw material supplied by the supply portion 10 contains, for example, fibers such as used paper and pulp sheet.

The coarse crushing portion 12 cuts the raw material supplied by the supply portion 10 into small pieces in the air such as in the atmosphere. The shape and size of the small pieces are, for example, small pieces of several cm square. In the illustrated example, the coarse crushing portion 12 has a coarse crushing blade 14, and the charged raw material can be cut by the coarse crushing blade 14. As the coarse crushing portion 12, for example, a shredder is used. The raw material cut by the coarse crushing portion 12 is received by a hopper 1 and then transferred to the defibrating portion 20 via a pipe 2.

The defibrating portion 20 defibrates the raw material cut by the coarse crushing portion 12. Here, "defibrating" means unraveling a raw material formed by binding a plurality of fibers into individual fibers. The defibrating portion 20 also has a function of separating resin particles adhering to the raw material, and a substance such as ink, toner, and bleeding inhibitor from the fibers.

A product that has passed through the defibrating portion 20 is called a "defibrated product". In addition to the unraveled defibrated product fiber, the "defibrated product" may contain resin particles separated from the fiber when the fiber is unraveled, a coloring agent such as ink and toner, and an additive such as a bleeding preventive material and a paper strength enhancer. The shape of the unraveled defibrated product is string-like. The unraveled defibrated product may exist in a state in which it is not entangled with other unraveled fibers, that is, in an independent state, or may exist in a state in which it is entangled with other unraveled defibrated products to form a lump, that is, in a state of forming a lump.

The defibrating portion 20 performs defibration in a dry manner. Here, performing processing such as defibration in the air such as in the atmosphere, not in a liquid, is referred to as a dry manner. As the defibrating portion 20, for example, an impeller mill is used. The defibrating portion 20 has a function of sucking the raw material and generating an air flow that discharges the defibrated product. As a result, the defibrating portion 20 can suck the raw material together with the air flow from an introduction port 22 by the air flow generated by itself, perform the defibration processing, and transport the defibrated product to a discharge port 24. The defibrated product that has passed through the defibrating portion 20 is transferred to the sorting portion 40 via a pipe 3. As the air flow for transporting the defibrated product from the defibrating portion 20 to the sorting portion 40, the air flow generated by the defibrating portion 20 may be used, or an air flow generation apparatus such as a blower may be provided to use the air flow thereof.

The sorting portion 40 introduces the defibrated product defibrated by the defibrating portion 20 from the introduction port 42 and sorts the fibers according to the length of the fibers. The sorting portion 40 has, for example, a drum portion 41 and a housing portion 43 that houses the drum portion 41. As the drum portion 41, for example, a sieve is used. The drum portion 41 has a net and can perform separation into the first sorted product that is fibers or particles smaller than the size of the net opening of the net, that is, that pass through the net, and the second sorted product that is fibers, un-defibrated pieces, or lumps larger than the size of the net opening of the net, that is, that do not pass through the net. For example, the first sorted product is transferred to the accumulating portion 60 via the pipe 7. The second sorted product is returned from the discharge port 44 to the defibrating portion 20 via the pipe 8. Specifically, the drum portion 41 is a cylindrical sieve that is rotationally driven by a motor. As the net of the drum portion 41, for example, a wire net, an expanded metal obtained by stretching a metal plate having a cut, or a punching metal in which a hole is formed in the metal plate by a press machine or the like is used.

The first web forming portion 45 transports the first sorted product that has passed through the sorting portion 40 to the pipe 7. The first web forming portion 45 has, for example, a mesh belt 46, a tension roller 47, and a suction mechanism 48.

The suction mechanism 48 can suck the first sorted product dispersed in the air by passing through the opening of the sorting portion 40 onto the mesh belt 46. The first sorted product is accumulated on the moving mesh belt 46 to form a web V. The basic configuration of the mesh belt 46, the tension roller 47, and the suction mechanism 48 is the same as that of a mesh belt 72, a tension roller 74, and a suction mechanism 76 of a second web forming portion 70, which will be described later.

By passing through the sorting portion 40 and the first web forming portion 45, the web V is formed in a soft and bulging state containing a large amount of air. The web V accumulated on the mesh belt 46 is charged into the pipe 7 and transported to the accumulating portion 60.

The rotating body 49 can cut the web V. In the illustrated example, the rotating body 49 has a base portion 49*a* and a protrusion 49*b* protruding from the base portion 49*a*. The protrusion 49*b* has, for example, a plate-like shape. In the illustrated example, the four protrusions 49*b* are provided, and the four protrusions 49*b* are provided at equal intervals. The base portion 49*a* rotates in a direction R, and thus the protrusion 49*b* can rotate about the base portion 49*a* as an axis. By cutting the web V by the rotating body 49, for example, the fluctuation of the amount of defibrated product per unit time supplied to the accumulating portion 60 can be reduced.

The rotating body 49 is provided in the vicinity of the first web forming portion 45. In the illustrated example, the rotating body 49 is provided in the vicinity of the tension roller 47*a* positioned downstream in the path of the web V. The rotating body 49 is provided at a position at which the protrusion 49*b* can come into contact with the web V and at a position at which the protrusion 49*b* does not come into contact with the mesh belt 46 on which the web V is accumulated. As a result, it is possible to suppress the mesh belt 46 from being worn by the protrusion 49*b*. The shortest distance between the protrusion 49*b* and the mesh belt 46 is, for example, 0.05 mm or more and 0.5 mm or less. This is the distance at which the web V can be cut without the mesh belt 46 being damaged.

The mixing portion 50 mixes, for example, the first sorted product that has passed through the sorting portion 40 and the additive. The mixing portion 50 has, for example, an additive supply portion 52 for supplying the additive, a pipe 54 for transporting the first sorted product and the additive, and a blower 56. In the illustrated example, the additive is supplied from the additive supply portion 52 to the pipe 54 via the hopper 9. The pipe 54 is continuous with the pipe 7.

In the mixing portion 50, an air flow is generated by the blower 56, and the first sorted product and the additive can be transported while being mixed in the pipe 54. The mechanism for mixing the first sorted product and the additive is not particularly limited, and may be one stirred by blades rotating at high speed, or may one using the rotation of the container like a V-type mixer.

As the additive supply portion 52, a screw feeder as illustrated in FIG. 1 or a disc feeder (not illustrated) or the like is used.

The additive supplied from the additive supply portion 52 is not particularly limited, and may contain, for example, a water-soluble polysaccharide such as a resin or starch for binding a plurality of fibers. In this case, the additive may contain a resin, but it may not contain the resin from a viewpoint that the environmental compatibility of the sheet can be further improved.

When the additive supplied from the additive supply portion 52 contains a resin, a plurality of fibers are not bound at the time when the additive is supplied. The resin is a thermoplastic resin or a thermosetting resin, for example, acrylonitrile styrene (AS) resin, acrylonitrile butadiene styrene (ABS) resin, polypropylene, polyethylene, polyvinyl chloride, polystyrene, acrylic resin, polyester, polyethylene terephthalate, polyphenylene ether, polybutylene terephthalate, nylon, polyamide, polycarbonate, polyacetal, polyphenylene sulfide, polyether ether ketone, or the like. These resins may be used alone or in an appropriate mixture. The additive supplied from the additive supply portion 52 may be in the form of fibers or in the form of powder.

The additives supplied from the additive supply portion 52 may include a colorant for coloring the fibers, an aggregation suppressant for suppressing the aggregation of the fibers and the aggregation of the additives, and a flame retardant for making fibers or the like hard to burn, depending on the type of the sheet to be manufactured. The mixture that has passed through the mixing portion 50 is transferred to the accumulating portion 60 via the pipe 54.

The accumulating portion 60 introduces the mixture that has passed through the mixing portion 50 from the introduction port 62, loosens the entangled defibrated product, and drops the product while dispersing the product in the air. Further, when the resin of the additive supplied from the additive supply portion 52 is in the form of fibers, the accumulating portion 60 loosens the entangled resin. As a result, the accumulating portion 60 can uniformly accumulate the mixture on the second web forming portion 70.

The accumulating portion 60 has, for example, a drum portion 61 and a housing portion 63 that houses the drum portion 61. As the drum portion 61, a rotating cylindrical sieve is used. The drum portion 61 has a net and allows fibers or particles smaller than the size of the net opening of the net contained in the mixture that has passed through the mixing portion 50 to drop. The configuration of the drum portion 61 is, for example, the same as the configuration of the drum portion 41.

The "sieve" of the drum portion 61 may not have a function of sorting a specific object. That is, the "sieve" used as the drum portion 61 means that the drum portion 61 is provided with a net, and the drum portion 61 may drop all of the mixture introduced into the drum portion 61.

The second web forming portion 70 accumulates the passing object that has passed through the accumulating portion 60 to form the web W. The second web forming portion 70 has, for example, a mesh belt 72, a tension roller 74, and a suction mechanism 76.

The passing object that has passed through the opening of the accumulating portion 60 is accumulated on the mesh belt 72. The mesh belt 72 is stretched by the tension roller 74, and has a configuration that allows air to pass through, which makes it difficult for the passing object to pass through. The mesh belt 72 moves by rotating the tension roller 74. The web W is formed on the mesh belt 72 by continuously accumulating the passing object that has passed through the accumulating portion 60 when the mesh belt 72 continuously moves.

The suction mechanism 76 is provided below the mesh belt 72. The suction mechanism 76 can generate a downward air flow. The mixture dispersed in the air by the accumulating portion 60 can be sucked onto the mesh belt 72 by the suction mechanism 76. As a result, the discharge rate from the accumulating portion 60 can be increased. Further, the suction mechanism 76 can form a downflow in the fall path of the mixture, and can prevent the defibrated products and the additive from being entangled during the fall.

As described above, the web W in a soft and bulging state containing a large amount of air is formed by passing through the accumulating portion 60 and the second web forming portion 70.

Moisture is imparted to the accumulated web W when being transported to the sheet forming portion 80. Moisture is imparted by the moisture imparting portion 78. The moisture imparting portion 78 imparts moisture for the web W to have a predetermined water content, and can be configured by, for example, water vapor, mist, shower, ink jet, or the like. Further, in the illustrated example, the suction mechanism 79 is provided at an opposite position of the moisture imparting portion 78 with the web W interposed therebetween. The suction mechanism 79 can generate a downward air flow. The moisture generated from the moisture imparting portion 78 can be passed through the web W to be sucked by the suction mechanism 79. As a result, moisture can be imparted more evenly in the thickness direction of the web W.

The web W to which the moisture is imparted by the moisture imparting portion 78 is transported to the sheet forming portion 80.

The sheet forming portion 80 forms the sheet S by pressurizing and heating the web W accumulated on the mesh belt 72. The sheet forming portion 80 applies pressure and heat to a mixture of a defibrated product and an additive that are mixed, accumulated, and imparted with moisture. In the sheet forming portion 80, the thickness of the web W is reduced to increase the density, and the moisture evaporates. The density increases due to pressure, and the moisture evaporates due to heat, so that a plurality of fibers are bonded by hydrogen bonds. As a result, the sheet S having good mechanical strength can be formed. Further, when the water-soluble polysaccharide is used as an additive, the density increases due to pressure, and the temperature of moisture and the water-soluble polysaccharide rises due to heat, so that the water-soluble polysaccharide gelatinizes, and then the moisture evaporates to bind a plurality of fibers via the gelatinized water-soluble polysaccharide. As a result, the sheet S having better mechanical strength can be formed. Further, when the resin is used as an additive, the resin is softened by heat, and a plurality of fibers are bound via the softened resin. As a result, the sheet S having better mechanical strength can be formed.

The sheet forming portion 80 has a pressurizing and heating portion 84 that pressurizes and heats the web W. The pressurizing and heating portion 84 functions as a pressurizing portion that pressurizes the web W and also functions as a heating portion that heats the web W. Although not illustrated, the sheet forming portion 80 may have a pressurizing portion that pressurizes the web W and a heating portion that heats the web W as separate mechanisms.

The pressurizing and heating portion 84 can be configured by using, for example, a heating roller or a heat press molding machine. Further, when the pressurizing portion and the heating portion are provided as separate mechanisms, the heating portion can also be configured by using a hot plate, a hot air blower, an infrared heater, and a flash fuser in addition to the above-mentioned mechanism. In the illustrated example, the pressurizing and heating portion 84 is a pair of heating rollers 86. The number of heating rollers 86 is not particularly limited. The pressurizing and heating portion 84 can pressurize and heat the web W at the same time.

The cutting portion 90 cuts the sheet S formed by the sheet forming portion 80. In the illustrated example, the cutting portion 90 includes a first cutting portion 92 that cuts the sheet S in a direction intersecting the transport direction of the sheet S, and a second cutting portion 94 that cuts the sheet S in a direction parallel to the transport direction. The second cutting portion 94 cuts, for example, the sheet S that has passed through the first cutting portion 92.

As a result, the sheet S of a single form having a predetermined size is formed. The cut sheet S of a single form is discharged to the discharge receiving portion 96.

2. Sheet Manufacturing Method

Figure 2:
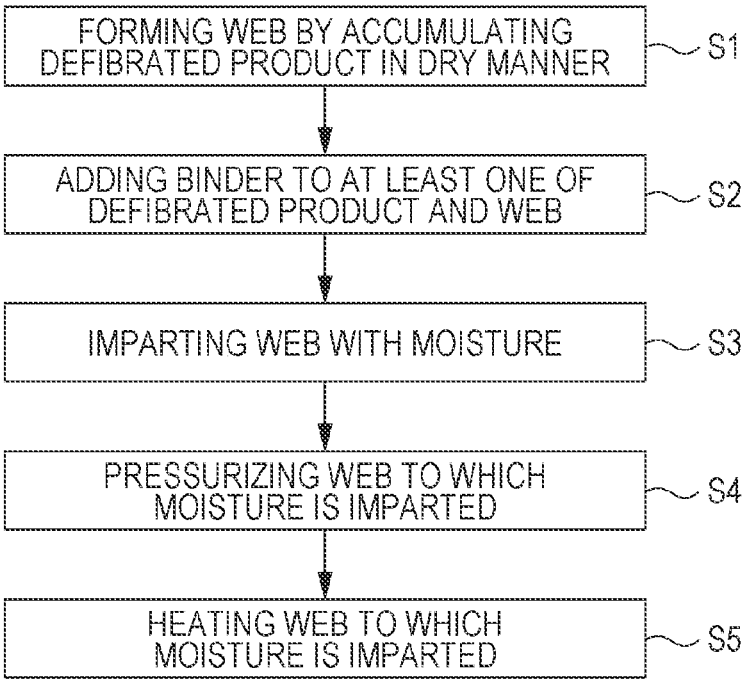
FIG. 2 is a flowchart for explaining a sheet manufacturing method according to a present embodiment.

Next, the sheet manufacturing method according to the present embodiment will be described with reference to the drawings. FIG. 2 is a flowchart for explaining the sheet manufacturing method according to the present embodiment. The sheet manufacturing method according to the present embodiment can be performed using, for example, the sheet manufacturing apparatus 100 described above.

As illustrated in FIG. 2, the sheet manufacturing method according to the present embodiment includes a web forming step of forming a web by accumulating a defibrated product in a dry manner (step S1), a binder adding step of adding a binder to at least one of the defibrated product and the web (step S2), a moisture imparting step of imparting moisture to the web (step S3), a pressurizing step of pressurizing the web to which the moisture is imparted (step S4), and a heating step of heating the web to which the moisture is imparted (step S5).

2.1. Web Forming Step

In the web forming step, a web is formed by accumulating a defibrated product in a dry manner. When the above-mentioned sheet manufacturing apparatus 100 is used, the defibrated product is formed by the defibrating portion 20. In the defibrated product, the accumulating portion 60 and the second web forming portion 70 accumulate the defibrated product in a dry manner to form a web.

The defibrated product contains fibers. The fiber is not particularly limited, and a wide range of fiber materials can be used. Examples of the fiber can include natural fiber (animal fiber, plant fiber), chemical fiber (organic fiber, inorganic fiber, organic-inorganic composite fiber), or the like. Further specifically, examples of the fiber may be fiber or the like made of cellulose, silk, wool, cotton, *cannabis*, kenaf, flax, ramie, jute, Manila hemp, sisal hemp, coniferous trees, broadleaf trees, or the like, and these may be used alone, may be appropriately mixed and used, or may be used as a recycled fiber treated with purification or the like. The fibers used in the sheet manufacturing method of the present embodiment have the ability to form hydrogen bonds.

Examples of the raw materials of the fiber include pulp, used paper, used cloth, or the like. Further, the fiber may be subjected to various surface treatments. Further, the material of the fiber may be a pure substance or may be a material containing a plurality of components such as impurities and other components.

The length of the fiber is not particularly limited, but in one independent fiber, the length along the longitudinal direction of the fiber is 1 μm or more and 5 mm or less, preferably 2 μm or more and 3 mm or less, more preferably 3 μm or more and 2 mm or less.

2.2. Binder Adding Step

In the binder adding step, the binder is added to at least one of the defibrated product and the web. In the binder adding step, the binder may be added only to the defibrated product, the binder may be added only to the web, or the binder may be added to both the defibrated product and the web. When the above-mentioned sheet manufacturing apparatus 100 is used, the binder adding step can be performed by the additive supply portion 52. As described above, the binder added in the binder adding step may be a resin such as polyester or may be a water-soluble polysaccharide such as starch.

The binder adding step may not be performed. By not performing the binder adding step, the step can be shortened. Further, by not adding the resin, a more environmentally friendly sheet can be manufactured. On the other hand, when the binder adding step is performed, a sheet having higher strength can be manufactured. Further, the binder adding step may be performed after the moisture imparting step as long as the binder adding step is performed before the pressurizing step and the heating step.

2.3. Moisture Imparting Step

In the moisture imparting step, the web is imparted with moisture. Specifically, in the moisture imparting step, water is imparted to the web. When the above-mentioned sheet manufacturing apparatus 100 is used, moisture can be imparted to the web W by the moisture imparting portion 78.

The amount of water imparted in the moisture imparting step can be managed by, for example, the water content of the web. The water content of the web to which the moisture is imparted in the moisture imparting step is 12% by mass or more and 60% by mass or less, preferably 14% by mass or more and 52% by mass or less, more preferably 14% by mass or more and 40% by mass or less, and still more preferably 15% by mass or more and 30% by mass or less.

Further, in the moisture imparting step, it is preferable that water vapor or mist is imparted to the web. In this way, the web can be more evenly imparted with moisture, and the sheet can be manufactured with a simpler apparatus configuration.

2.4. Pressurizing Step

In the pressurizing step, the web to which the moisture is imparted is pressurized. The pressurizing step can be performed by the sheet forming portion 80 when the above-mentioned sheet manufacturing apparatus 100 is used.

The pressurizing step applies pressure to the web, thins the web, and increases the density of the web. The pressure applied to the web by the pressurizing step is 0.2 MPa or more and 15 MPa or less, preferably 0.2 MPa or more and 13 MPa or less, more preferably 0.3 MPa or more and 10 MPa or less, and still more preferably 0.4 MPa or more and 2.0 MPa or less.

2.5. Heating Step

In the heating step, the web to which the moisture is imparted is heated. When the above-mentioned sheet manufacturing apparatus 100 is used, the heating step can be performed by the sheet forming portion 80. The pressurizing step and the heating step are performed at the same time, for example. As a result, the manufacturing method becomes simpler, and the configuration of the apparatus that performs the manufacturing method can be simplified. The pressurizing step and the heating step may not be performed at the same time. In this case, the heating step may be performed after the pressurizing step, or the pressurizing step may be performed after the heating step.

In the heating step, heat is applied to the web to evaporate the moisture contained in the web. The temperature of the web in the heating step is 100° C. or lower. In the heating step, the temperature of the web is heated to preferably 50° C. or higher and 100° C. or lower, more preferably 60° C. or higher and 98° C. or lower, and further preferably 70° C. or higher and 96° C. or lower.

2.6. Other Steps

The sheet manufacturing method of the present embodiment may include, for example, a defibrating step, a sorting step, a cutting step, or the like, in addition to the above-mentioned steps. By using the above-mentioned sheet manufacturing apparatus 100, these steps can be easily performed by the defibrating portion 20, the sorting portion 40, the first web forming portion 45, the rotating body 49, the cutting portion 90, or the like.

2.7. Action Effect

A sheet manufacturing method of the present embodiment includes a web forming step of forming a web by accumulating a defibrated product in a dry manner, a moisture imparting step of imparting moisture to the web, a pressurizing step of pressurizing the web to which the moisture is imparted, and a heating step of heating the web to which the moisture is imparted. The water content of the web to which the moisture is imparted in the moisture imparting step is 12% by mass or more, the pressure applied to the web in the pressurizing step is 0.2 MPa or more, and the temperature of the web in the heating step is 100° C. or less.

Accordingly, in the sheet manufacturing method of the present embodiment, a plurality of fibers contained in the defibrated product can be bound by hydrogen bonds. As a result, a sheet having sufficient strength can be manufactured without using a resin. Specifically, hydrogen bonds between fibers can be formed by setting the water content of the web to 12% or more and then heating at a temperature of 100° C. or lower. For example, when heated at a temperature higher than 100° C., molecular motion becomes intense and hydrogen bonds are difficult to form. Further, by increasing the water content of the web to 12% or more and then pressurizing the web, the density of the web can be increased at a lower pressure, and the apparatus can be miniaturized. Further, by forming the web by accumulating the defibrated product in a dry manner, the amount of moisture used for forming the web can be reduced as compared with the wet papermaking method.

In the sheet manufacturing method of the present embodiment, the water content of the web to which the moisture is imparted in the moisture imparting step may be 40% by mass or less. When the water content of the web is 40% by mass or less, the transportability and moldability of the web can be improved.

In the sheet manufacturing method of the present embodiment, the pressure applied to the web in the pressurizing step may be 10 MPa or less. When the pressure applied to the web is 10 MPa or less, the deterioration of the fiber can be suppressed. Accordingly, the sheet can be manufactured again using the defibrated product obtained by defibrating the manufactured sheet as a raw material.

In the sheet manufacturing method of the present embodiment, the temperature of the web in the heating step may be 60° C. or higher. When the temperature of the web is 60° C. or higher, the time required for the heating step can be reduced.

3. Example and Comparative Example 3.1. Production of Sheet

A sheet was produced using an apparatus corresponding to the sheet manufacturing apparatus 100 described above. The defibrated product was accumulated in a dry manner to form a web, and after imparting the web with moisture, the web to which moisture was imparted was pressurized and heated by a pair of rollers to produce a sheet. A binder such as a resin or a water-soluble polysaccharide was not used. The pressurizing and the heating of the web were performed at the same time.

FIG. 3 is a table that illustrates the production condition of No. 1 to 10 sheets. As illustrated in FIG. 3, the amount of moisture (water content) to be imparted, the pressure, and the temperature of the roller were allocated. The basis weight of the No. 1 to 10 sheets was approximately 80 g/cm$^2$. The pressure was calculated based on the following equations (1) and (2).

$$\text{pressure}=\text{load imparted to the roller/nip area} \quad (1)$$

$$\text{nip area}=\text{roller width}\times\text{nip width} \quad (2)$$

The nip width was measured by the following method. First, the temperature of the pair of rollers was raised to 100° C. Next, a commercially available laminated sheet was sandwiched between a pair of rollers and nipped (a predetermined load was imparted). Next, the nip was opened in substantially 1 second, and the laminated sheet was taken out. Next, since the heated portion of the laminated sheet became transparent, the width of the transparent portion was measured.

Figure 4:
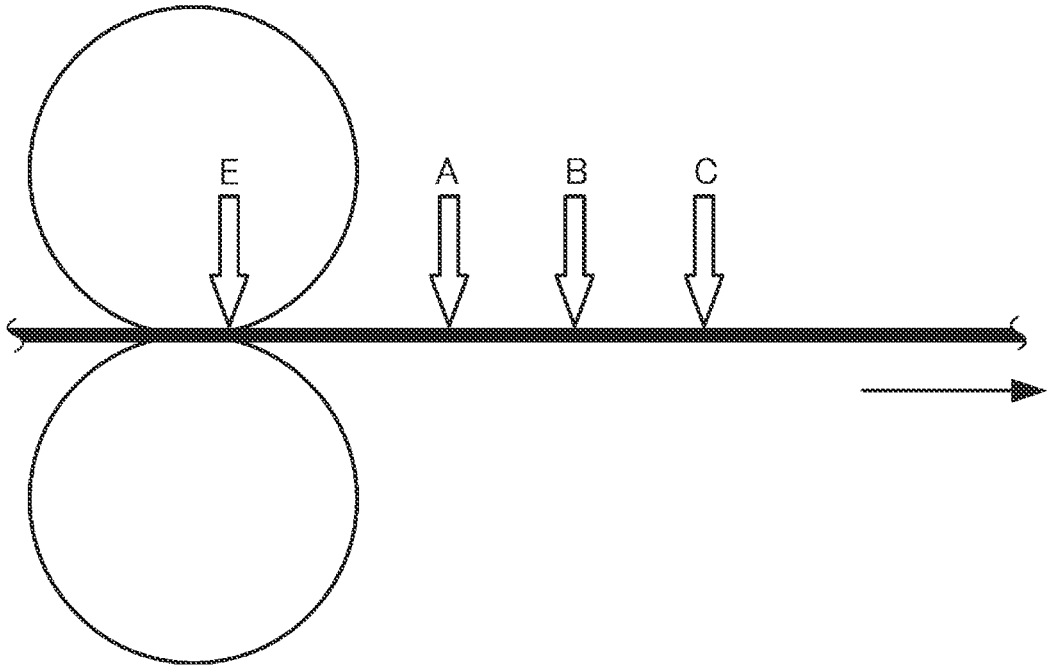
FIG. 4 is a diagram for explaining a method of calculating a density of a sheet.

As for the sheet temperature, as illustrated in FIG. 4, the sheet temperature was measured with a radiation thermometer at positions A, B, and C away from a nip outlet E. The following is an example of the measurement result. The sheet temperature is the temperature of the heated web. FIG. 4 is a diagram for explaining a method of calculating the density of the sheet.

Measurement Position Arrival Time from Nip Outlet E (s) Sheet Temperature (° C.)

A 1. 2 72

B 2. 0 64

C 2. 8 57

A graph was created with the arrival time from the nip outlet E as the horizontal axis and the sheet temperature as the vertical axis. Then, an approximate curve was created with a quadratic curve, and the temperature at x=0 (nip outlet) was calculated. In the above example, the approximate curve is represented by the following equation (3), and the sheet temperature of the intercept is 85.9° C.

$$y=0.7813x^2-12.5x+85.875 \quad (3)$$

3.2. Evaluation Condition

The sheet produced as described above were evaluated for strength, density, drying time, and repeated recycle.

3.2.1. Strength

In this experimental example, the strength is the specific tensile strength. A sheet piece having a width of 10 mm and a length of 50 mm was cut out from the produced sheet, and a specific tensile strength was obtained based on the following equation (4). The specific tensile strength was evaluated by a tensile test. As the test apparatus, "AGS-X500N" manufactured by Shimadzu Corporation was used. The tensile speed was 1 mm/s.

$$\text{specific tensile strength } (N\cdot m/g)=\text{maximum tensile load } (N)/\text{sheet piece width (mm)}/\text{sheet piece basis weight } (g/cm^2) \quad (4)$$

The evaluation criteria for the specific tensile strength (N·m/g) are as follows.

A: 10 or more

B: 8 or more and less than 10

C: less than 8

3.2.2. Density

Figure 5:
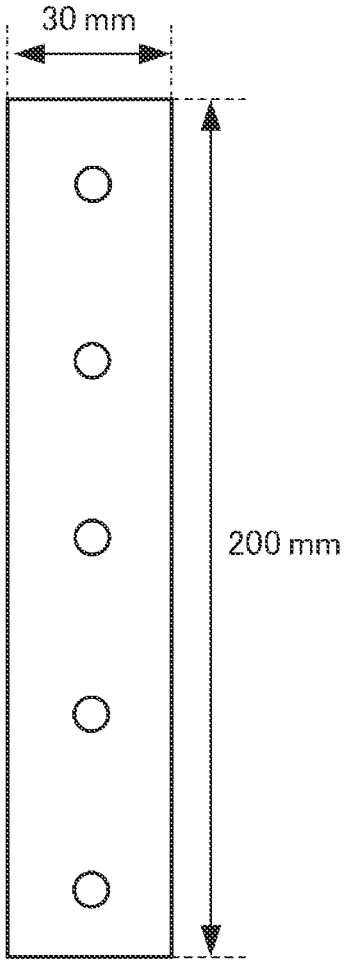
FIG. 5 is a diagram for explaining a method of calculating a sheet temperature.

A sheet piece having a size of 30 mm×200 mm was cut out from the produced sheet, the thickness and mass of the sheet piece were measured, and the density was calculated from the following equation (5). The thickness was obtained by measuring 5 places on the sheet piece with a micrometer as illustrated by the circle illustrated in FIG. 5 to calculate the average value. FIG. 5 is a diagram for explaining a method of calculating the sheet temperature.

$$\text{density}=\text{mass}/(\text{thickness}\times 3\times 20) \quad (5)$$

The evaluation criteria for density (g/cm$^3$) are as follows.

A: 0.55 or more

B: 0.50 or more and less than 0.55

C: less than 0.50

3.2.3. Drying Time

The standard drying time was 0.8 seconds, and when drying in 0.8 seconds, the drying time was left as it was (drying time was 0.8 seconds). When the moisture was too high to dry in 0.8 seconds, the number of rotations of the heating roller was reduced to extend the time it took for the sheet to pass through the nip of the heating roller. The number of rotations at which the water content of the sheet after drying was 10% by mass or less was adopted, and the drying time at that time was used as an index. Specifically, the drying time was calculated from the following equation (6).

$$\text{drying time (s)}=\text{nip width (mm)}/\text{roller peripheral speed (mm/s)} \quad (6)$$

As a measuring apparatus for measuring the water content, "MX-50" manufactured by A&D Co., Ltd. was used. The heating pattern was set as "a method of keeping the drying time constant". A sheet piece was cut out from the sheet so that the mass of the sheet piece was 1 g, and evaluated.

The evaluation criteria for the drying time (s) are as follows.

A: 1.2 or less

B: Greater than 1.2 and 5 or less

C: greater than 5

3.2.4. Repeated Recycle

Papermaking was performed from recycled paper that was made as a raw material, and this was repeated twice to measure the strength. That is, papermaking was performed three times in total. The method for measuring the strength is as described above. The ratio of the strength of the one-time recycle RC1 and the three-time recycle RC3 (RC3 strength/RC1 strength) was obtained.

The evaluation criteria for repeated recycle are as follows.

A: Ratio is 0.9 or more

B: Ratio is 0.8 or more and less than 0.9

C: Ratio is less than 0.8

3.3. Evaluation Result

In FIG. 3, the evaluation results of the No. 1 to 10 sheets are illustrated. The No. 1, 2, 5, 7 to 10 sheets are the sheets according to the example. The No. 3, 4, and 6 sheets are sheets according to the comparative example.

As illustrated in FIG. 3, the No. 1 sheet had "A" in all the evaluation items, and the evaluation results were better than those of the No. 2 to 10 sheets.

The No. 2 sheet had high strength and density, but the sheet temperature was low, so that it took a long time to dry.

Since the No. 3 sheet had a high sheet temperature, hydrogen bonds were not formed, and the strength and density were low.

Since the pressure of the No. 4 sheet was low, the sheet could not be completely crushed and the density was low. Accordingly, the strength was also low.

The No. 5 sheet had a good first recycle, but the pressure was too high, so that the fibers deteriorated and the evaluation of repeated recycle was poor.

Since the No. 6 sheet had a low water content, hydrogen bonds were not formed, and the strength and density were low.

The water content of the No. 7 sheet was too high, so that water oozed out from the sheet at the nip and dripping occurs. Further, it took time to dry.

Since the water content of the No. 8 sheet was low, the strength of the first time was slightly low. Further, since the pressure was high, the evaluation of repeated recycle was slightly poor.

The No. 9 sheet had a slightly higher water content, so the drying time was slightly longer.

The No. 10 sheet had a slightly high water content, but on the other hand, the pressure was slightly low, so that the strength of the first time was slightly low. Repeated recycle was a good evaluation.

The present disclosure includes a configuration substantially the same as the configuration described in the embodiment, for example, a configuration having the same function, method and result, or a configuration having the same purpose and effect. The present disclosure also includes a configuration in which a non-essential part of the configuration described in the embodiment is replaced. Further, the present disclosure includes a configuration that exhibits the same action effect as the configuration described in the embodiment or a configuration that can achieve the same object. Further, the present disclosure includes a configuration in which a technique in related art is added to the configuration described in the embodiment.

The following contents are derived from the embodiment described above.

One aspect of the sheet manufacturing method includes a web forming step of forming a web by accumulating a defibrated product in a dry manner, a moisture imparting step of imparting the web with moisture, a pressurizing step of pressurizing the web to which the moisture is imparted, and a heating step of heating the web to which the moisture is imparted, in which a water content of the web to which the moisture is imparted in the moisture imparting step is 12% by mass or more, a pressure applied to the web in the pressurizing step is 0.2 MPa or more, and a temperature of the web in the heating step is 100° C. or lower.

According to the sheet manufacturing method, a sheet having sufficient strength can be manufactured without using a resin.

In one aspect of the sheet manufacturing method, the water content of the web to which the moisture is imparted in the moisture imparting step may be 40% by mass or less.

According to the manufacturing method, the transportability and moldability of the web can be improved.

In one aspect of the sheet manufacturing method, the pressure applied to the web in the pressurizing step may be 10 MPa or less.

According to the manufacturing method, the sheet can be manufactured again using the defibrated product obtained by defibrating the manufactured sheet as a raw material.

In one aspect of the sheet manufacturing method, the temperature of the web in the heating step may be 60° C. or higher.

According to the manufacturing method, the time required for the heating step can be reduced.

In one aspect of the sheet manufacturing method, the pressurizing step and the heating step may be performed at the same time.

According to the manufacturing method, the configuration of the apparatus that performs the manufacturing method can be simplified.

In one aspect of the sheet manufacturing method, before the pressurizing step and the heating step, a binder adding step of adding a binder to at least one of the defibrated product and the web may be included.

According to the manufacturing method, a sheet having higher strength can be manufactured.

In one aspect of the sheet manufacturing method, in the moisture imparting step, water vapor or mist may be imparted to the web.

According to the manufacturing method, the sheet can be manufactured with a simpler apparatus configuration.

One aspect of the sheet manufacturing apparatus includes a web forming portion that forms a web by accumulating a defibrated product in a dry manner, a moisture imparting portion that imparts moisture to the web, a pressurizing portion that pressurizes the web to which the moisture is imparted, and a heating portion that heats the web to which the moisture is imparted, in which a water content of the web to which the moisture is imparted in the moisture imparting portion is 12% by mass or more, a pressure applied to the web in the pressurizing portion is 0.2 MPa or more, and a temperature of the web in the heating portion is 100° C. or lower.

According to the sheet manufacturing apparatus, a sheet having sufficient strength can be manufactured without using a resin.

What is claimed is:

1. A sheet manufacturing method comprising:

a web forming step of forming a web by accumulating a defibrated product in a dry manner;

a moisture imparting step of imparting the web with moisture;

a pressurizing step of pressurizing the web to which the moisture is imparted; and a heating step of heating the web to which the moisture is imparted, wherein a water content of the web to which the moisture is imparted in the moisture imparting step is 12% by mass or more, a pressure applied to the web in the pressurizing step is 0.2 MPa or more, and a temperature of the web in the heating step is 100° C. or lower.

2. The sheet manufacturing method according to claim 1, wherein a water content of the web to which the moisture is imparted in the moisture imparting step is 40% by mass or less.

3. The sheet manufacturing method according to claim 1, wherein the pressure applied to the web in the pressurizing step is 10 MPa or less.

4. The sheet manufacturing method according to claim 1, wherein the temperature of the web in the heating step is 60° C. or higher.

5. The sheet manufacturing method according to claim 1, wherein the pressurizing step and the heating step are performed at the same time.

6. The sheet manufacturing method according to claim 1, further comprising:

before the pressurizing step and the heating step, a binder adding step of adding a binder to at least one of the defibrated product and the web.

7. The sheet manufacturing method according to claim 1, wherein water vapor or mist is imparted to the web in the moisture imparting step.

8. A sheet manufacturing apparatus comprising:

a belt on which a defibrated product is accumulated in a dry manner to form a web;

a moisture imparting portion that imparts moisture to the web;

a pressurizing portion that is arranged downstream of the moisture imparting portion and that pressurizes the web to which the moisture is imparted; and a heating portion that is arranged downstream of the moisture imparting portion and that heats the web to which the moisture is imparted, wherein a water content of the web to which the moisture is imparted in the moisture imparting portion is 12% by mass or more, a pressure applied to the web in the pressurizing portion is 0.2 MPa or more, and a temperature of the web in the heating portion is 100° C. or lower.

* * * * *